United States Patent [19]

Freze

[11] 4,010,550

[45] Mar. 8, 1977

[54] CONTINUOUS PROCESSING APPARATUS AND METHOD FOR TEXTILE FABRICS

[75] Inventor: Benjamin H. Freze, Anaheim, Calif.

[73] Assignee: Challenge-Cook Bros., Incorporated, Industry, Calif.

[22] Filed: July 28, 1975

[21] Appl. No.: 599,625

[52] U.S. Cl. ..... 34/23; 34/28; 34/33; 34/129; 34/135; 34/156; 68/5D; 68/20

[51] Int. Cl.² ..... F26B 3/04

[58] Field of Search ..... 34/135, 141, 142, 151, 34/152, 155, 156, 23, 28, 33, 129; 259/75, 13, 56; 8/149.2, 149.3; 68/5 D, 5 E, 20; 26/18.5

[56] References Cited

UNITED STATES PATENTS

| | | | |
|---|---|---|---|
| 2,661,520 | 12/1953 | Hamilton et al. | 26/18.5 |
| 3,815,257 | 6/1974 | Freze | 34/129 |
| 3,938,356 | 2/1976 | Arendt | 68/5 D |

*Primary Examiner*—John J. Camby
*Assistant Examiner*—Larry I. Schwartz
*Attorney, Agent, or Firm*—Lyon & Lyon

[57] ABSTRACT

An apparatus and method utilizing an oscillating drum through which is passed a continuous web of textile fabric moved axially through the drum by synchronized drive means; the drum including confronting grid structures having angularly arranged portions which serve to prevent tangling the web as the web is moved forward and the drum oscillates. Hot air is introduced adjacent the entrance end and exit end of the drum and into the drum itself to maintain the web in suspension; and, optionally, live steam may be directed against the web before entering the drum.

16 Claims, 5 Drawing Figures

CONTINUOUS PROCESSING APPARATUS AND METHOD FOR TEXTILE FABRICS

BACKGROUND AND SUMMARY

Attempts have been made to pass a continuous web of textile fabric axially through a drum while subjecting the web to hot air, steam or other treatment; however, it does not appear that such procedure has heretofore met with success. Apparently this is due to the tendency of the web to tangle.

The present invention is directed to a continuous processing apparatus and method for textile fabrics which may utilize an adaption of a tumbler dryer having a housing and drum such as disclosed in U.S. Pat. No. 3,601,903, in which the drum is modified and caused to oscillate instead of rotate, and includes other features which permits a wide range of treatments, either individually or in succession, such as relaxing, bulking, drying or shrinking a continuously web of textile fabric as it is moved through the drum, and is summarized in the following objects:

First, to provide an apparatus and method of processing a continuously moving web of textile fabric, wherein the tumbler drum is provided with novelly arranged longitudinally extending grid structures having angularly disposed panels, the grid structures defining a zone extending between the entrance and exit ends of the drum which has an average depth less than the width of the web, and a width greater than the width of the web, the grid structures causing the web to twist a limited amount in either direction from an essentially horizontal transverse axis without causing the web to tangle. Second, to provide an apparatus and method, as indicated in the preceeding object, in which sychronized drive means is provided near the entrance and exit ends of the drum to maintain within the drum a predetermined length of web in excess of the length of the drum permitting the web to fold transversely.

Third, to provide an apparatus and method, as indicated in the other objects, in which means is provided for applying a transversely distributed fluid force to opposite sides of the web as it enters into and exits from the drum, such force being supplied, for example, by hot air, thereby facilitating at the exit end of the drum, full recovery from such twisting of the web as produced by oscillation of the drum and grid structures.

Fourth, to provide an apparatus and method of continuous treatment of a textile fabric web wherein a pair or more of drums may be arranged in tandem relation to increase the number of treatments or duration thereof.

DETAILED DESCRIPTION

The present invention utilizes in part, features disclosed more fully in Pat. No. 3,601,903. That is, the present invention utilizes a housing 1 and drum 2, a drive means and hot air supply and exhaust means more fully disclosed in the above mentioned patent, these components being modified for the purpose of the present invention, as will be brought out hereinafter.

Figure 2:
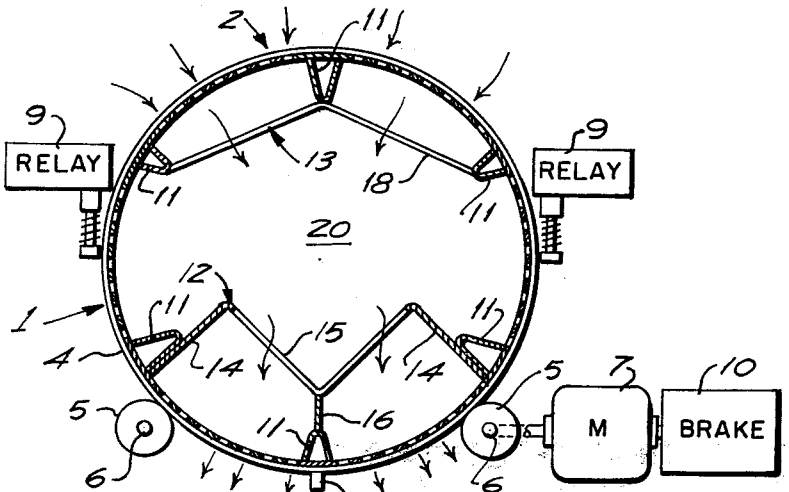
FIG. 2 is a reduced transverse sectional view of the drum, taken through 2—2 of FIG. 1 and indicating diagrammatically the means for effecting oscillation of the drum.

The drum 2 is in the form of a perforated cylindrical shell having tapered ends 3 forming an inlet at one axial end and outlet at the opposite axial end. Adjacent its ends the drum is provided with annular supporting tracks 4 which, rest on pairs of drive wheels 5, connected by drive shafts 6 connected to a drive motor 7, all as shown in more detail in U.S. Pat. No. 3,601,903. In this patent the drum is intended to rotate continuously, in the present invention the drum is intended to oscillate, this may be accomplished by a reversing finger 8 protruding radially from the drum as shown in FIG. 2, finger being arranged to engage alternately, a pair of relays 9 for controlling the degree of oscillating movement. In order to minimize over-travel it is preferred to provide a brake 10 for the motor.

The drum as disclosed in U.S. Pat. No. 3,601,903, is provided with a set of hollow ribs 11, which serve to tumble laundry contained in the drum. In the present invention, these ribs are utilized to support a lower grid structure 12 and an upper grid structure 13, the lower grid structure 12 includes a pair of side panels 14, secured to a pair of the internal ribs 11 and sloping inwardly toward each other in approximately 90° relation. The radially inner extremities of the side panels 14 are connected by V shaped bars 15 the portions of which are in approximately 90° relation and converge outwardly to apices joined by an anchor strip 16 to an internal rib 11, located between the ribs to which the side panels 14 are attached. Near the axial extremities of the grid structure 12, the connecting bars 15, define a surface converging toward the corresponding open end of the drum and are joined to panels 17 which continue to the end of the drum and are joined to the margin of the corresponding drum opening.

The upper grid structure 13 includes a series of connecting bars 18 which are V shaped defining an obtuse angle, the axial extremity of the set of connecting bars 18 are joined by end panels 19 to the corresponding end of the drum.

The upper and lower grid structures form a tumbler zone 20, the depth of which, as will be brought out hereinafter, is less than the width of the web which is to be processed in the drum and the transverse section of the zone is greater than such web.

The housing 1 includes end plates 21 and 22. The end plate 21 is provided with a drum entrance opening 23 of rectangular configuration. Mounted over the drum entrance opening 23 is an entrance enclosure which forms an entrance chamber 24 having an upwardly directed entrance slot 25. Within the chamber 24 is mounted a drive roller 26 and a driven roller 27. Between the rollers and the end plate 21 there is formed a lower air inlet compartment 28 which discharges air upwardly through a perforated wall 29 and an upper inlet compartment 30 which discharges air downwardly through perforated wall 31.

The other end plate 22 is provided with an exit opening 32. Fitted over the opening 32 is an exit enclosure forming an exit chamber 33. The exit chamber is provided with an exit slot 34. A lower air inlet compartment 35 is provided under the exit chamber 33 and communicates therewith to a perforated wall 36; similarly, an upper air inlet compartment 37 communicates with the exit chamber through a perforated wall 38.

Disposed beyond the exit slot 34 is a drive roller 39 and a driven roller 40. The drive rollers 26 and 39 are driven by motors 41 which are connected by a synchronizer 42.

Externally of the entrance chamber 24, in alignment with the slot 25 and the contacting portions of the rollers 26 and 27 is an initial guide roller 43. Beyond the drive and driven rollers 39 and 40 is an upper and lower final guide roller 44 and 45.

The exit chamber is provided with an access door 46 bordering the slot 34. Other access doors, not shown, are provided at convenient locations.

The method of processing the web of textile is as follows:

The web of textile fabric, designated 47, passes over the initial guide roller 33, between the drive and driven rollers 26 and 27 and enters the drum through entrance opening 23. The length of the web intended to be maintained in the drum may range from a length twice the axial length of the drum to a length four times the axial length of the drum, and optimum length is approximately three times the axial length of the drum. As a consequence, the web, particularly in the first half of the drum, tends to form transverse folds 48.

The drive roller 26 and driven roller 27 are equal to or exceed the width of the web 47 and they define horizontal axes so that in a transverse direction the web, as it passes between the rollers, is horizontal. As the web passes from the rollers into the entrance end of the drum, air uniformaly distributed throughout the width of the web is directed upwardly, as well as downwardly through the perforated walls 29 and 31. The opposing force of the air streams maintains the web, suspended, and as the web curves downward the initial portion of the web tends to remain free of any twisting force until engaged by the grid structures 12 and 13.

Figure 4:
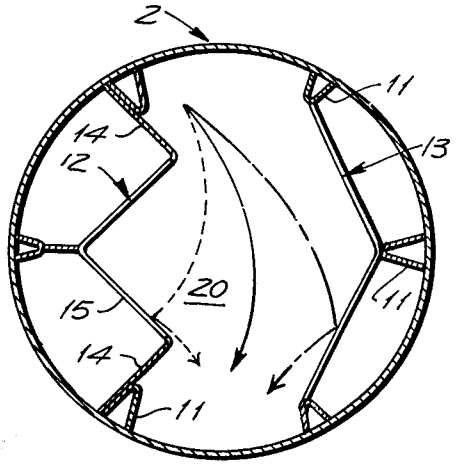
FIGS. 3 and 4 sectional views of the drum corresponding to FIG. 2, and showing the drum in its two extreme positions of oscillation.
Figure 3:
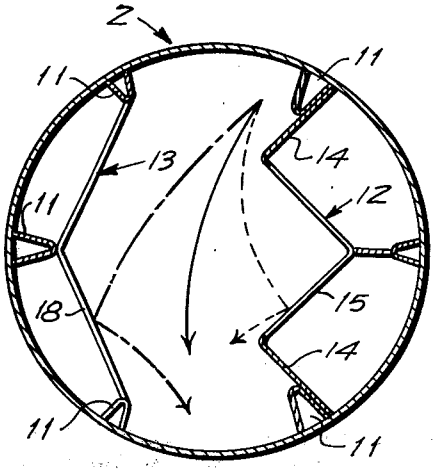

As the drum is oscillated, preferably approximately 90° in opposite direction, the web is deflected and caused to twist a limited amount as represented by the arrows in FIGS. 3 and 4. This limited and benificial twisting movement continues as the web moves through the drum. As the web approaches the exit chamber the air from the lower and upper perforated walls 36 and 38 urge the web towards a transversely horizontal position for exit through the slot 34 and between the drive roller 39 and driven roller 40.

A duct is provided between the upper half of the housing 1 and the drum 2, the introduction of air through perforations provided in the drum 2, such as shown more fully in U.S. Pat. No. 3,606,903. Also, as shown in this patent, the air is drawn through an exhaust duct communicating with the lower portion of the drum, these ducts are used in conjunction with the apparatus herein illustrated. The discharge duct, the entrance end of which is indicated by 49 serves to discharge not only the air introduced through the upper portion of the drum, but also the air introduced through the perforated walls 29, 31, 36 and 38.

Figure 1:
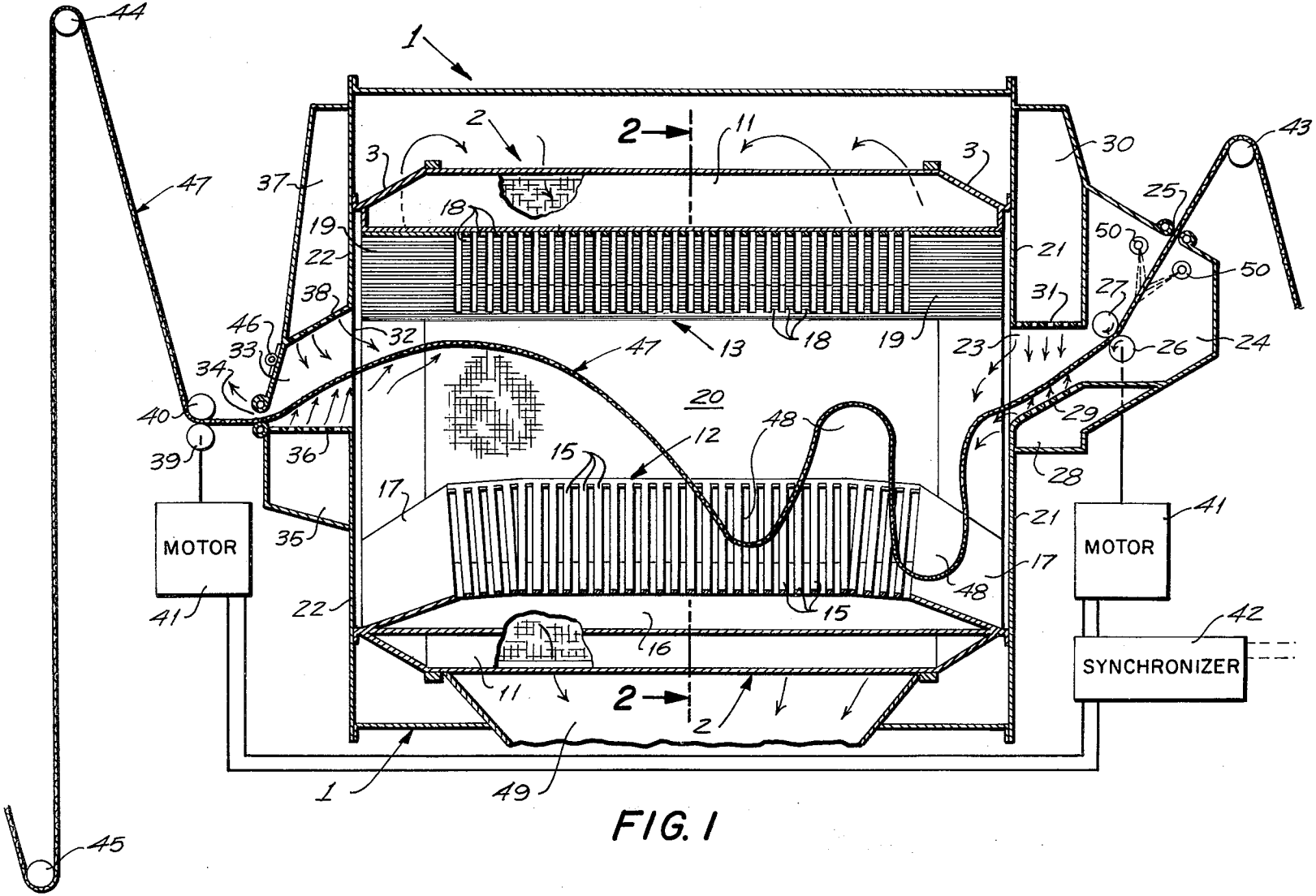
FIG. 1 is an essentially diagrammatical longitudinal sectional view of the apparatus for processing textile fabrics showing a web of textile fabric as it appears when passing through the apparatus during a period of mid-oscillation.

Air entering through these walls may be supplied from the same source as the air supplied in the manner shown in the aforementioned patent, to the upper portion of the drum. However, as it may for some treatments be desirable to provide hotter or cooler air than that supplied directly to the drum, separate sources of air may be provided. Still further, should it be desirable to introduce special treatment chemicals, such chemicals in a gaseous state may be introduced through selected perforated walls. Also it may be desired to utilize selected perforated walls for the introduction of wet steam. However, it may be preferred to introduce steam through steam tubes 50 having jet openings directed toward opposite side of the web and located within the entrance chamber 24, as indicated in FIG. 1.

Figure 5:
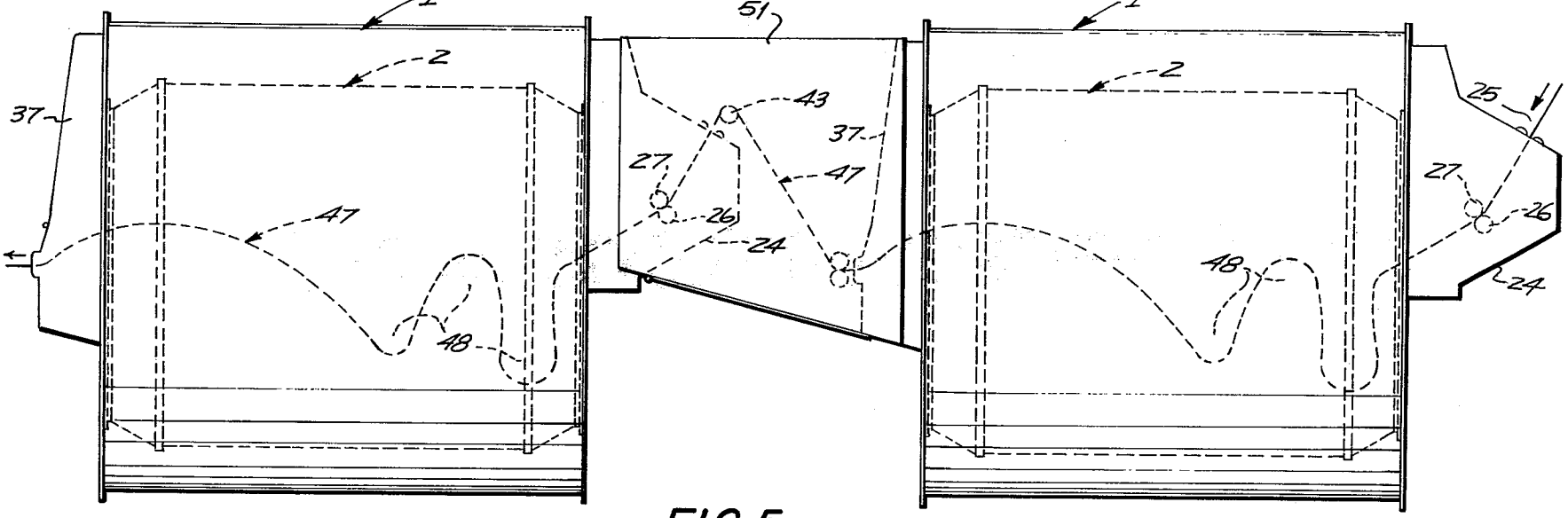
FIG. 5 is an essentially diagrammatical side view showing a pair of processing apparatus in tandem.

Referring to FIG. 5, a pair of more of the drums 2 and their housings 1 may be positioned in tandem, each unit retaining its entrance chamber 24 and exit chamber 35, the exit chamber of the first unit being connected to the entrance chamber of the second unit by a shell 51.

While, the drum 2 is shown as horizontally disposed, it may have a sloping axis as shown in U.S. Pat. No. 3,815,257; that is, essentially horizontal as distinquished from truly horizontal.

Having fully described my invention it is to be understood that I am not to be limited to the details herein set forth, but that my invention is of the full scope of the appended claims.

I claim:

1. An apparatus for processing a continuous web of textile fabric, comprising:

a. drum oscillatable about an essentially horizontal axis and having an entrance end and an exit end;

b. the drum further including a pair of confronting grid structures extending between said ends forming a tumbler chamber having axially extending angularly related walls forming a zone having a depth less than the web of textile fabric and a width greater than the web, the grids being movable on oscillation of the drum between essentially vertically and horizontally related positions;

c. a housing surrounding the drum and having entrance and exit walls covering the entrance and exit ends of the drum and forming entrance and exit openings;

d. means defining an entrance chamber including the housing entrance wall and communicating through the entrance opening with the interior of the drum;

e. means defining an exit chamber including the housing exit wall and communicating through the exit opening with the interior of the drum;

f. an entrance drive means positioned to feed a continuous web of textile fabric through the entrance chamber into the drum;

g. an exit drive means positioned to withdraw the web from the drum through the exit chamber;

h. and means for sychronizing the entrance movement and exit movement of the web to maintain within the drum a length of web in excess of the length of the drum;

i. said drum, upon oscillation, causing limited twisting and lateral displacement of the web in opposite directions as the web moves between the entrance and exit ends of the drum.

2. An apparatus as defined in claim 1, wherein:

a. means is provided to introduce air against the web to maintain the web in suspension at the entrance and exit ends of the drum.

3. An apparatus as defined in claim 2, wherein:

a. said air introduction means includes air inlet ports below and above the web as it passes into and exits from the drum.

4. An apparatus as defined in claim 2, wherein:
a. air entering the ends of the drum is withdrawn from the underside of the drum.

5. An apparatus as defined in claim 1, wherein:
a. the entrance drive means is disposed in the entrance chamber;
b. and steam jets are directed against the web in the entrance chamber in the vicinity of the entrance drive means.

6. An apparatus as defined in claim 1, wherein:
a. the length of the web maintained in the drum is in the range between two and four times the length of the drum.

7. An apparatus as defined in claim 1, wherein:
a. at least a pair of drums are disposed in tandem;
b. and a shell connects the exit chamber for the first drum with the entrance chamber for the second drum.

8. An apparatus for processing a continuous web of textile fabric, comprising:
a. an essentially horizontally disposed drum having an entrance end and an exit end;
b. a housing surrounding the drum and enclosing the ends thereof;
c. means including the housing forming an entrance chamber having an essentially horizontal inlet opening into the drum;
d. means including the housing forming an exit chamber having an essentially horizontal exit opening from the drum;
e. synchronized means for moving a web of textile fabric through the entrance chamber, drum, and exit chamber and maintaining a length of web in the drum exceeding the length of the drum to cause the web to fold transversely;
f. means for directing air into the entrance and exit chambers at opposite sides of the web and into the extremities of the drum to maintain the web portions at the extremities of the drum in an essentially horizontal position;
g. and means for oscillating the drum to cause limited twisting of the web intermediate the end portions of the drum alternately in opposite directions from the horizontal position of the web.

9. An apparatus as defined in claim 8, wherein:
a. a pair of confronting grid structures including angularly related panels is disposed within the drum to form a zone having a depth less than the width of the web and a width greater than the width of the web;
b. said zone having, during oscillation of the drum, a mid-position in alignment with the inlet and exit openings and extreme positions in opposite angular relation to the inlet and exit openings.

10. A method of processing a continuous web of textile fabric, characterized by:
a. continuously feeding a web of textile fabric into an entrance end of a drum, through the drum, and an exit end of the drum;
b. maintaining a length of web in the drum exceeding the length of the drum to cause the web to fold transversely;
c. oscillating the drum to cause limited twisting of the web in opposite directions while passing through the drum;
d. and subjecting the web, at least at one end region of the drum, to laterally distributed fluid impact at opposite sides thereof, thereby tending to maintain the web in said region in an untwisted state.

11. A method as defined in claim 10, further characterized by:
a. maintaining the web at the entrance and exit ends of the drum in an untwisted state.

12. A method as defined in claim 10, further characterized by:
a. applying wet steam to opposite sides of the web during movement of the web into the drum.

13. A method of processing a continuous web of textile fabric, characterized by:
a. synchronously feeding a web of textile fabric into one end and out the other end of an essentially horizontal treatment chamber;
b. maintaining a length of web in the chamber exceeding the length of the chamber thereby to cause the web to fold transversely as the web passes through the chamber;
c. maintaining the entering and exiting portions of the web essentially horizontal in a transverse direction;
d. causing limited twisting of the web in opposite directions from its transversely horizontal position as the web passes between the ends of the chamber;
e. and applying, at the entrance end of the chamber, a fluid distributed across opposite sides of the web to effect suspension of the web and tending to maintain the web in its transversely horizontal position during entry into the chamber.

14. A method as defined in claim 13, further characterized by:
a. applying a treatment fluid distributed across opposite sides of the web at the entrance end of the chamber.

15. A method as defined in claim 13, further characterized by:
a. applying, at the exit end of the chamber, a fluid distributed across opposite sides of the web to effect suspension of the web and tending to restore the web to its transversely horizontal position during discharge from the chamber.

16. A method as defined in claim 13, further characterized by:
a. applying treatment fluid to the web as it passes through the chamber.

* * * * *